US006740165B1

(12) United States Patent
Mensing et al.

(10) Patent No.: US 6,740,165 B1
(45) Date of Patent: May 25, 2004

(54) METHOD OF ADJUSTING THE HEIGHT OF A NIP OF AN ADHESIVE APPLICATOR APPARATUS FOR A WEB OF CORRUGATED BOARD AND APPARATUS FOR PUTTING THE METHOD INTO PRACTICE

(75) Inventors: Hermann Mensing, Weiherhammer (DE); Markus Schrödl, Weiherhammer (DE); Ernst Zimmerer, Weiden (DE); Thomas Hecky, Weiden (DE)

(73) Assignee: BHS Corrugated Maschinen- und Anlagenbau GmbH, Weiherhammer (DE)

( * ) Notice: Subject to any disclaimer, the term of this patent is extended or adjusted under 35 U.S.C. 154(b) by 0 days.

(21) Appl. No.: 10/619,498

(22) Filed: Jul. 16, 2003

Related U.S. Application Data

(62) Division of application No. 09/982,798, filed on Oct. 22, 2001, now Pat. No. 6,620,455.

(30) Foreign Application Priority Data

Oct. 20, 2000 (DE) ..... 100 52 372

(51) Int. Cl.[7] ..... B05C 1/08

(52) U.S. Cl. ..... 118/663; 118/712; 118/249; 118/259; 156/578

(58) Field of Search ..... 118/663, 679, 118/692, 712, 249, 258, 259; 156/210, 470, 578

(56) References Cited

U.S. PATENT DOCUMENTS

| | | | | |
|---|---|---|---|---|
| 3,300,359 A | | 1/1967 | Nikkel | |
| 4,319,947 A | * | 3/1982 | Tokuno | 156/351 |
| 5,681,422 A | * | 10/1997 | Marschke | 156/472 |
| 6,068,701 A | | 7/2000 | Kohler et al. | |
| 6,409,857 B2 | * | 6/2002 | Pallas et al. | 156/64 |

FOREIGN PATENT DOCUMENTS

EP 0 825 017 A1 2/1998

* cited by examiner

*Primary Examiner*—Laura Edwards
(74) *Attorney, Agent, or Firm*—Browdy and Neimark

(57) ABSTRACT

In an adhesive applicator apparatus comprising an adhesive applicator roll and a nip roll, a web of corrugated board is led through the nip that is formed between the rolls. In the nip, the web of corrugated board is pressed against the adhesive applicator roll by a given constant force.

6 Claims, 2 Drawing Sheets

METHOD OF ADJUSTING THE HEIGHT OF A NIP OF AN ADHESIVE APPLICATOR APPARATUS FOR A WEB OF CORRUGATED BOARD AND APPARATUS FOR PUTTING THE METHOD INTO PRACTICE

This is a division of parent application Ser. No. 09/982,798, filed Oct. 22, 2001 now U.S. Pat. No. 6,620,455.

BACKGROUND OF THE INVENTION

1. Field of the Invention

The invention relates to a method of adjusting the height of a nip between an adhesive applicator roll and a nip roll of an adhesive applicator apparatus for a web of corrugated board, and to an adhesive applicator apparatus for putting the method into practice.

2. Background Art

When a single-face lined web of corrugated board is to be provided with another liner on its non-faced side, then glue must be applied to the tips of the corrugated web on the non-faced side. To this end, the single-face lined medium is led through the nip of an adhesive applicator, a so-called sizing press. In doing so, it is extraordinarily difficult to regulate the height of the nip in such a way that on the one hand the hydrodynamic pressure of the thin adhesive layer on the adhesive applicator roll is overcome for gluing of the tips of the corrugated web to take place, and that on the other hand the corrugated web will not be crushed and the tips are not overly loaded with glue by too low an adjustment of the height of the nip.

SUMMARY OF THE INVENTION

It is an object of the invention to embody a method of adjusting the height of a nip between an adhesive applicator roll and a nip roll of an adhesive applicator apparatus for a web of corrugated board and an adhesive applicator apparatus for putting the method into practice, by means of which to have optimal gluing of the tips of the corrugated web of a single-face lined web of corrugated board.

According to the invention, this object is attained by a method including the following steps: conveying, through the nip, the web of corrugated board, which at least includes a liner web and a corrugated web with tips turned away from the liner web; applying an adhesive on the tips of the corrugated web by means of the adhesive applicator roll, with the liner web bearing against the nip roll; and pressing the web of corrugated board by a given constant force between the adhesive applicator roll and the nip roll. This object is further attained by an adhesive applicator apparatus comprising a frame; an adhesive applicator roll, which is disposed in the frame and drivable in rotation about a central longitudinal axis; a nip roll, which is disposed in the frame and drivable in rotation about a central longitudinal axis; a nip between the adhesive applicator roll and the nip roll for a web of corrugated board to pass through, which comprises at least one liner web and a corrugated web; a force sensitive device for detection of an actual force which acts vertically on the web of corrugated board in the nip; a distance adjusting device for modification of the height of the nip by displacement of the rolls relative to each other substantially on a plane that is spanned by the central longitudinal axes; and a control unit for comparison of the actual force with a given nominal force in the nip and for triggering the distance adjusting device. The actual force required in the nip for optimal gluing of the tips of the corrugated web is determined empirically.

Further features, advantages and details of the invention will become apparent from the ensuing description of an exemplary embodiment, taken in conjunction with the drawing.

DESCRIPTION OF THE PREFERRED EMBODIMENT

Figure 1:
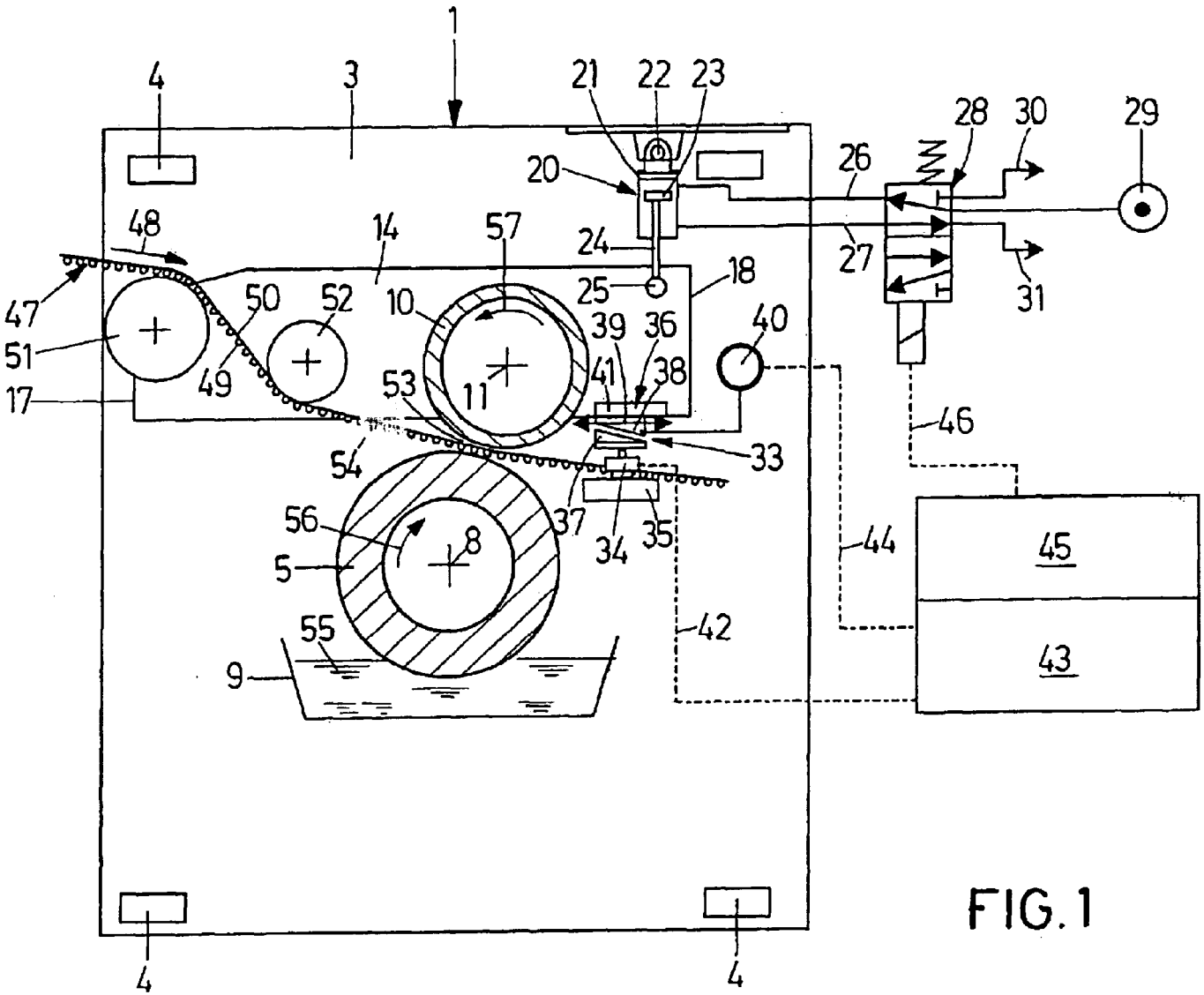
FIG. 1 is a vertical longitudinal section through an adhesive applicator apparatus according to the invention.
Figure 2:
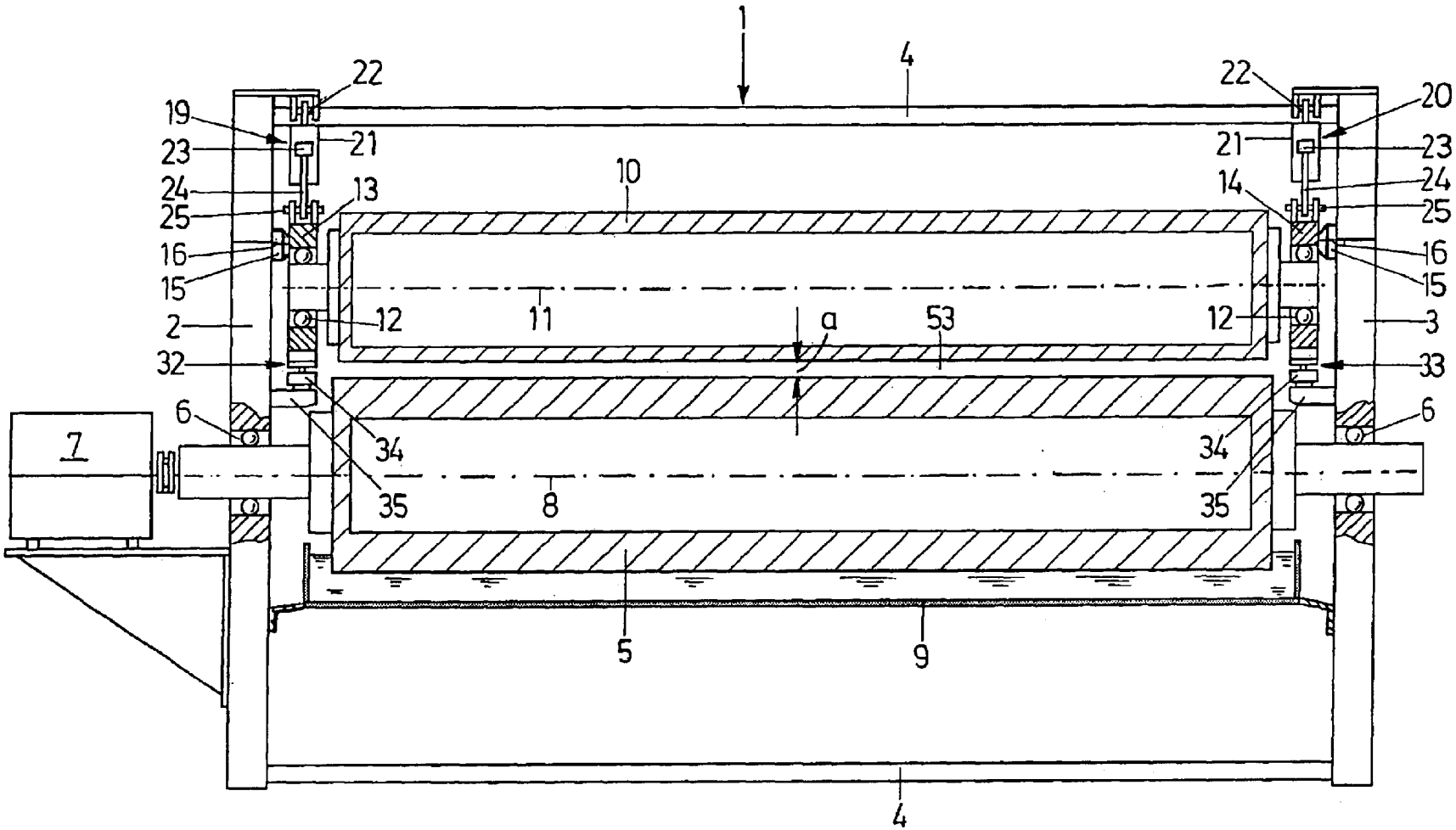
FIG. 2 is a vertical cross section through the adhesive applicator apparatus of FIG. 1.

The adhesive applicator apparatus seen in the drawing includes a frame 1, which substantially comprises two side walls 2, 3 joined to each other by cross struts 4. In the side walls 2, 3, an adhesive applicator roll 5 is rotatably run on bearings 6, which is drivable in rotation about its horizontal central longitudinal axis 8 by an electric driving motor 7. The driving motor 7 is supported on the side wall 2. Disposed underneath the adhesive applicator roll 5 is an adhesive pan 9, into which dips the applicator roll 5.

Disposed above the applicator roll 5 is a nip roll 10, the central longitudinal axis 11 of which runs substantially parallel to the axis 8. The nip roll 10 is run freely rotatably on bearings 12 in bearing levers 13, 14. These bearing levers 13, 14 are again run on bearings 15 on the side walls 2, 3 for free pivoting about a common pivot axis 16. The pivot axis 16 is also parallel to the axes 8, 11. The pivot axis 16 is located in the proximity of an end 17 of the levers 13, 14—which is the left end in FIG. 1—whereas the nip roll 10 is lodged at a distance therefrom in the proximity of the other end 18 of the levers 13, 14—which is the right end in FIG. 1.

In the proximity of the ends 18 that are allocated to the nip roll 10, a nip pressure actuation 19, 20 acts on each lever 13, 14, which is a fluid actuated, in particular pneumatically actuated piston cylinder 21. Each cylinder 21 of the actuations 19,20 is articulated to the side wall 2 or 3 for pivoting about a common pivot axis 22 that is parallel to the axes 8, 11, 16. The piston rod 24, which is mounted on the piston 23, is articulated to the respective lever 13 and 14 for pivoting about a pivot axis 25 that is also parallel to the axes 8, 11, 16, 22. The actuations 19, 20 can be actuated bi-laterally i.e., fluid lines 26, 27 open into the respective cylinder 21 on both sides of the piston 23. The lines 26, 27 are connected to a solenoid valve 28 to which hydraulic fluid can be supplied at a constant pressure from a hydraulic fluid source 29. Return lines 30, 31, which are allocated to the lines 26, 27, discharge from the valve 28.

A nip pressure adjusting device 32, 33 is disposed between each lever 13, 14 and the frame 1. It comprises a force sensing device 34, for instance a so-called load cell, which is stationarily supported on the respective side wall 2 and 3 by way of a support plate 35. The force sensing device 34 supports itself on the respective lever 13, 14 by way of a distance adjusting device 36. This adjusting device 36 comprises two wedges 37, 38, one of which—the upper wedge 38—is adjustable relative to the other—lower wedge 37—in accordance with the arrow of adjusting direction 39. Adjusting the wedge 38 takes place by means of an adjusting drive 40, which is for instance a spindle drive. The displaceable wedge 38 is supported on the respective lever 13 and 14 by way of a thrust bearing 41. The lower wedge 37 is not displaceable in the direction of the arrow 39. Vertical displaceability towards the force sensing device 34 is not necessary, these measuring systems working approximately without displacement.

Via a signal line 42, the force sensing device 34 is connected to a control unit 43 which is again connected to the adjusting drive 40 by a corresponding control line 44. Furthermore, a control unit 45 is provided, which is connected to the solenoid valve 28 by means of a control line 46.

A single-face web of corrugated board 47 is led through the adhesive applicator apparatus in the conveying direction 48. The web of corrugated board 47 comprises a corrugated web 49 and a liner web 50. Upon arrival in the apparatus, the web of corrugated board 47 is led with its corrugated web 49 passing along a deflection roll 51 and then with its liner web 50 passing along a smoothing roll 52. Then it is led through the nip 53 between the applicator roll 5 and the nip toll 10, the downward tips 54 of the corrugated web 49 being provided with an adhesive 55 that is supplied by the adhesive applicator roll 5 from the adhesive pan 9 in the form of a thin film on the adhesive applicator roll 5. In the nip 53, the rolls 5, 10 rotate in the conveying direction 48 i.e., in the direction of rotation 56 and 57, respectively.

Adjusting the height a of the nip 53 and adjustment control takes place by the force that is exercised by the rolls 5, 10 on the web of corrugated board 47 being kept at a constant given value.

To this end, constant pressure from the hydraulic fluid source 29 acts on the pressure actuations 19 and 20 for them to act on the respective lever 13 and 14 by a constant force. These forces and the forces that result from the weight of the levers 13, 14, of the nip roll 10 and of the parts located on the levers 13, 14 are altogether constant. These forces work downwards. Working counter thereto are forces that act in the nip 53 on the one hand and on the nip pressure adjusting devices 32, 33 on the other in the opposite direction upwards. The sum of these forces is also constant. The actual force exercised on the web of corrugated board 47 in the nip 53 depends on the forces that occur in the nip pressure adjusting devices 32, 33. If the force of pressure exercised on the web of corrugated board 47 in the nip 53 is to be increased, then the forces working in the devices 32, 33 must be reduced correspondingly and vice versa.

The actual force that works in the device 32 and 33 and is detected in the force sensing device 34 is continuously transmitted by the device 34 via the signal line 42 to the control unit 43 where the sum thereof is compared with a preset nominal force. This preset nominal force may also correspond to the force that is to act on the web of corrugated board 47 in the nip 53. Since, for the reasons mentioned above, the sum of these forces and the sum of the forces that work in the devices 32, 33 is constant, corresponding conversion may take place in the control unit 43. If the sum of the actual forces measured in each force sensing device 34 exceeds the preset nominal force, this implies that the actual force that works in the nip 53 has become to low, meaning that the height a thereof has become too great In this case, a control signal is emitted to each adjusting drive 40 for displacement of the associated wedge 37 in such a direction that the height a of the nip 53 is reduced, this taking place sufficiently long for the actual forces sensed in the devices 32, 33—and, indirectly, the force working in the nip 53—to correspond again to the preset nominal value.

If however the sum of the actual forces measured in each force sensing device 34 becomes smaller than the preset nominal force, this implies that the actual force working in the nip 53 has become to great, meaning that the height a thereof has become too small. In this case, a control signal is emitted to each adjusting drive 40 for displacement of the associated wedge 37 in such a direction that the height a of the nip 53 is increased, this taking place sufficiently long for the actual forces sensed in the devices 32, 33—and, indirectly, the force working in the nip 53—to correspond again to the preset nominal value.

The control unit 43 and the control unit 45 may be linked to each other in such a way that, at the start of an adhesive application job, a basic height a for web of corrugated board 47 is fed in for the control unit 45 so that the adjusting process does not take too long.

The nip pressure actuation 19 also serves to lift the nip roll 10 upwards.

The web of corrugated board 47 with adhesive spread on it by the adhesive applicator apparatus is customarily fed to a known board liner where another liner web is applied to the tips 54 of the corrugated web 49 with adhesive spread thereon.

Instead of the design described above, control of the force of pressure in the nip 53 and thus control of the height a of the nip 53 over its entire length may also take place in such a way that the forces measured by the two force sensing devices 34 of the nip pressure adjusting devices 32, 33 are not added up and then treated in the way described, but that they are individually compared to in each case half the nominal force value in the nip 53 and that then corresponding individual triggering of the distance adjusting devices 36 of the nip pressure adjusting devices 32 and 33 takes place. In this way, non-parallel adjustment of the rolls 5 and 10 relative to each other may take place i.e., the nip 53 may possibly not have the same height a over the entire length; but in this way varying thicknesses of the web of corrugated board 47 may be compensated over the width thereof so that too low or too high forces of pressure cannot occur over the width of the web of corrugated board 47.

What is claimed is:

1. An adhesive applicator apparatus for putting into practice a method of adjusting the height a of a nip (53) between an adhesive applicator roll (5) and a nip roll (10) of an adhesive applicator apparatus for a web of corrugated board (47), comprising a frame (1);

an adhesive applicator roll (5), which is disposed in the frame (1) and drivable in rotation about a central longitudinal axis (8);

a nip roll (10), which is disposed in the frame (1) and drivable in rotation about a central longitudinal axis (11), at least one of the applicator roll (5) and the nip roll (10) being a displaceable roll;

a nip (53) between the adhesive applicator roll (5) and the nip roll (10) for a web of corrugated board to pass through, which comprises at least one liner web (50) and a corrugated web (49);

a force sensitive device (34) for detection of an actual force which acts vertically on the web of corrugated board (47) in the nip (53);

a distance adjusting device (36) for modification of the height a of the nip (53) by displacement of the applicator roll (5) and the nip roll (10) relative to each other substantially on a plane that is spanned by the central longitudinal axes (8, 11); and a control unit (43) for comparison of the actual force with a given nominal force in the nip (53) and for triggering the distance adjusting device (36).

2. An adhesive applicator apparatus according to claim 1, wherein one roll (5) of the applicator roll (5) and the nip roll (10) is stationarily lodged in the frame (1); and wherein the other roll (10) of the nip roll (10) and the applicator roll (5) is lodged in bearing levers (13, 14), which are pivotably lodged in the frame (1).

3. An adhesive applicator apparatus according to claim 1, wherein the adhesive applicator roll (5) is lodged stationarily in the frame (1); and wherein the nip roll (10) is displaceable relative to the adhesive applicator roll (5).

4. An adhesive applicator apparatus according to claim 1, wherein a nip pressure actuation (19) is coupled with at least one displaceable roll (10) of said applicator roll (5) and said nip roll (10), exercising a given constant force on this roll (10).

5. An adhesive applicator apparatus according to claim 1, wherein a nip pressure adjusting device (32) acts on the at least one displaceable roll (10).

6. An adhesive applicator apparatus according to claim 5, wherein the force sensitive device (34) and the device (34) and the adjusting device (36) act on the at least one displaceable roll (10).

* * * * *